United States Patent [19]

Schiele et al.

[11] 4,147,465

[45] Apr. 3, 1979

[54] MEANS FOR ABRUPTLY TERMINATING THE FLOW OF FLUID IN CLOSED FLUID CIRCUIT SYSTEMS OF NUCLEAR REACTOR PLANTS OR THE LIKE

[75] Inventors: Otto Schiele, Neustadt, Fed. Rep. of Germany; Dusan Florjancic, Winterthur, Switzerland

[73] Assignee: Klein, Schanzlin & Becker Aktiengesellschaft, Frankenthal/Pfalz, Fed. Rep. of Germany

[21] Appl. No.: 828,227

[22] Filed: Aug. 26, 1977

Related U.S. Application Data

[63] Continuation-in-part of Ser. No. 394,210, Sep. 4, 1973, Pat. No. 4,073,595.

[30] Foreign Application Priority Data

Sep. 2, 1972 [DE] Fed. Rep. of Germany ..... 2243365

[51] Int. Cl.[2] ..... F03B 15/06

[52] U.S. Cl. ..... 415/143; 415/147

[58] Field of Search ..... 415/143, 146, 147, 215, 415/199 A

[56] References Cited

U.S. PATENT DOCUMENTS

| | | | |
|---|---|---|---|
| 330,753 | 11/1885 | Trullinger | 415/146 |
| 1,075,300 | 10/1913 | Moss | 415/183 |
| 1,094,836 | 4/1914 | Delaval | 415/183 |
| 1,287,920 | 12/1918 | Duda | 415/183 |
| 2,400,240 | 5/1946 | Lincoln | 415/129 |
| 2,555,312 | 6/1951 | Bollay | 415/143 |
| 2,692,080 | 10/1954 | Schwaiger | 415/147 |
| 2,778,563 | 1/1951 | Doyle | 415/146 |
| 2,905,375 | 9/1959 | Hanus et al. | 415/157 |
| 3,807,894 | 4/1974 | O'Rourke | 415/146 |
| 3,977,808 | 8/1976 | Schiele et al. | 415/1 |

FOREIGN PATENT DOCUMENTS

| | | | |
|---|---|---|---|
| 690613 | 7/1964 | Canada | 415/55 |

*Primary Examiner*—C. J. Husar

*Attorney, Agent, or Firm*—Michael J. Striker

[57] ABSTRACT

A nuclear steam supply system wherein each of a plurality of centrifugal pumps begins to operate with full cavitation in response to an abrupt drop of system pressure in the event of leakage. This is achieved by influencing a net positive suction head of each pump over the entire range of fluid flow and/or by influencing the net positive suction head upstream of the pumps. The first mode of causing the pumps to operate with full cavitation includes an appropriate selection of the inlet angle and/or inlet diameter of the pump impeller, the provision of auxiliary stationary guide wheels which are located upstream of the pumps and can circulate the fluid in or counter to the direction of rotation of the respective pump impellers, or the provision of suitably curved guide vanes in the pumps. The second mode includes interrupting the admission of undercooled fluid into the system upstream of the pumps.

3 Claims, 6 Drawing Figures

MEANS FOR ABRUPTLY TERMINATING THE FLOW OF FLUID IN CLOSED FLUID CIRCUIT SYSTEMS OF NUCLEAR REACTOR PLANTS OR THE LIKE

CROSS-REFERENCE TO RELATED APPLICATION

The present application is a continuation-in-part application of the copending application, Ser. No. 394,210, filed Sept. 4, 1973 now U.S. Pat. No. 4,073,595.

BACKGROUND OF THE INVENTION

The present invention relates to a method and means for compensating for an abrupt pressure drop in a closed system for the circulation of a fluid, especially in the primary cooling circuit of a nuclear reactor plant. More particularly, the invention relates to improvements in safety systems which are used to automatically compensate for a pressure drop in closed circuits for the circulation of a fluid, such as in the primary cooling circuit of a nuclear reactor plant wherein the cooling medium is circulated by one or more internal or external centrifugal pumps.

It is well known to provide the primary cooling circuit in a nuclear reactor plant with a safety system which serves to compensate for an aburpt drop of system pressure. As a rule, the motor for the pump which circulates the fluid is arrested in immediate response to a predetermined drop of system pressure below the normal pressure. This is considered important and necessary since, when the drop of system pressure is attributable to a leak, further operation of the pump could result in uncontrolled escape of substantial quantities of contaminated fluid. The presently known safety systems embody means for automatically arresting the pump motor in response to a detected drop of fluid pressure. It has been found that such safety systems cannot prevent excessive leakage of fluid because the pressure drop often develops within a small fraction of a second whereas the rotary parts of a centrifugal pump often continue to rotate by inertia for a period of one or more minutes. Thus, the pump continues to deliver fluid which is free to escape from the closed circuit through one or more leaks. The danger which is inherent in such leakage will be readily appreciated when one considers that the capacity of a primary recirculating pump may reach or exceed 24,000 cubic meters per hour.

It is further known to provide closed circuits with rapidly closing valves which are capable of abruptly interrupting the flow of fluid in the circuit. Such valves are extremely complex and expensive and their operation must be controlled by complicated control systems whose complexity is another factor which is likely to contribute to extensive leakage in the event of malfunction.

SUMMARY OF THE INVENTION

An object of the invention is to provide a novel and improved method of automatically compensating for or counteracting an abrupt drop of system pressure in a closed circuit for the circulation of a fluid, such as the coolant in the primary cooling circuit of a nuclear reactor plant, according to which a predetermined drop of system pressure automatically entails immediate or practically immediate termination of fluid circulation.

Another object of the invention is to provide in a closed circuit for the circulation of a fluid a novel and improved safety system which can influence the operation of a centrifugal pump in automatic response to a predetermined drop of system pressure to thereby terminate the circulation of fluid without resorting to complex and expensive valves or the like.

A further object of the invention is to provide a safety system which is simpler than heretofore known safety systems and which is capable of terminating the circulation of fluid with a higher degree of reliability and more rapidly than heretofore known safety systems.

Another object of the invention is to provide a safety system which need not employ discrete monitoring means for the pressure of circulating fluid.

The method of the present invention can be resorted to for automatically counteracting or compensating for an abrupt drop of system pressure in a closed circuit wherein a fluid is normally circulated by at least one centrifugal pump at constant pressure, particularly in the primary cooling circuit of a nuclear reactor plant. The method comprises the steps of operating the centrifugal pump without cavitation at normal system pressure, and operating the pump with maximum or full cavitation in response to a predetermined (and preferably substantial) drop of system pressure below the normal pressure.

An important advantage of the improved method is that the quantity of displaced fluid is reduced, practically without any delay, to a few percent of the normal throughput by the relatively simple expedient of changing the cavitation of the centrifugal pump.

In accordance with our method, the pump is operated without cavitation at the point of maximum efficiency. The net positive suction head (NPSH) which is important for development of cavitation is low at the point of best efficiency. Such head increases substantially outside of the point of best efficiency. The rise of NPSH is in a direction toward partial load if it is to be expected that, in the event of a drop of system pressure, the pump will operate in the partial load range. However, if a drop of system pressure is likely to cause the pump to operate in the overload range, the rise of NPSH should take place in a direction toward overload. A rise of NPSH in both directions should be contemplated if one cannot accurately predict the operation of the pump in the event of a drop of system pressure, i.e., whether the pump is then likely to operate in the partial load range or in the overload range. In the latter instance, a curve representing the required NPSH as a function of flow has a low point which is desirable, especially when the full drop of system pressure does not take place within a short interval of time, for example, in the event of a small leak.

The novel features which are considered as characteristic of the invention ae set forth in particular in the appended claims. The improved safety system itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
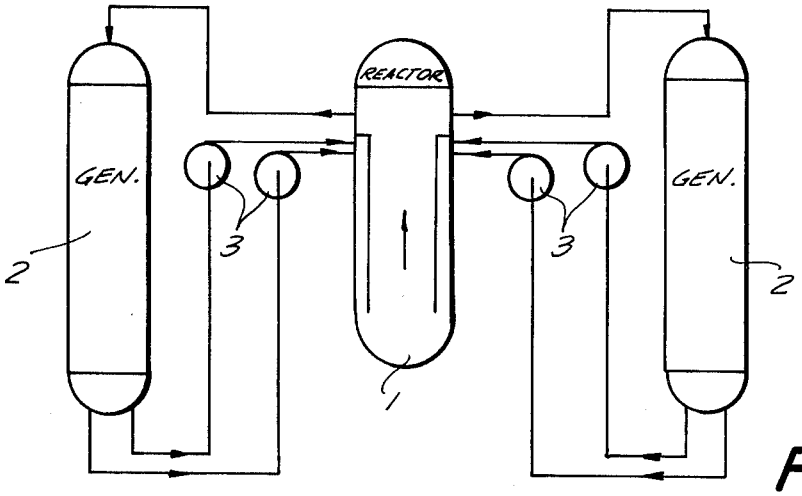
FIG. 1 is a schematic elevational view of a nuclear steam supply system with four centrifugal pumps whose cavitation can be controlled in accordance with the method of the present invention.

FIG. 1 illustrates schematically a nuclear steam supply system with a reactor 1, two steam generators 2 and four centrifugal pumps 3. The directions in which the fluid is circulated are indicated by arrows.

Figure 2:
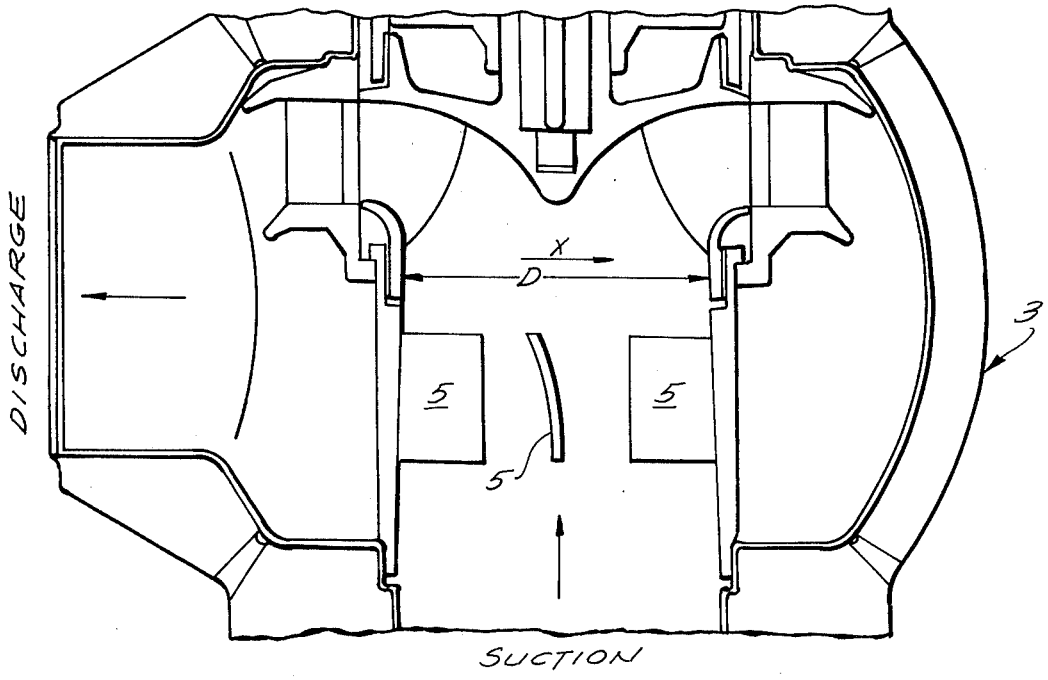
FIG. 2 is an enlarged sectional view of one of the centrifugal pumps.

FIG. 2 shows a portion of one of the pumps 3. The direction of rotation of the pump impeller 4 is clockwise, as viewed from the top, and as indicated by the arrow x. The guide vanes are shown at 5.

Figure 3:
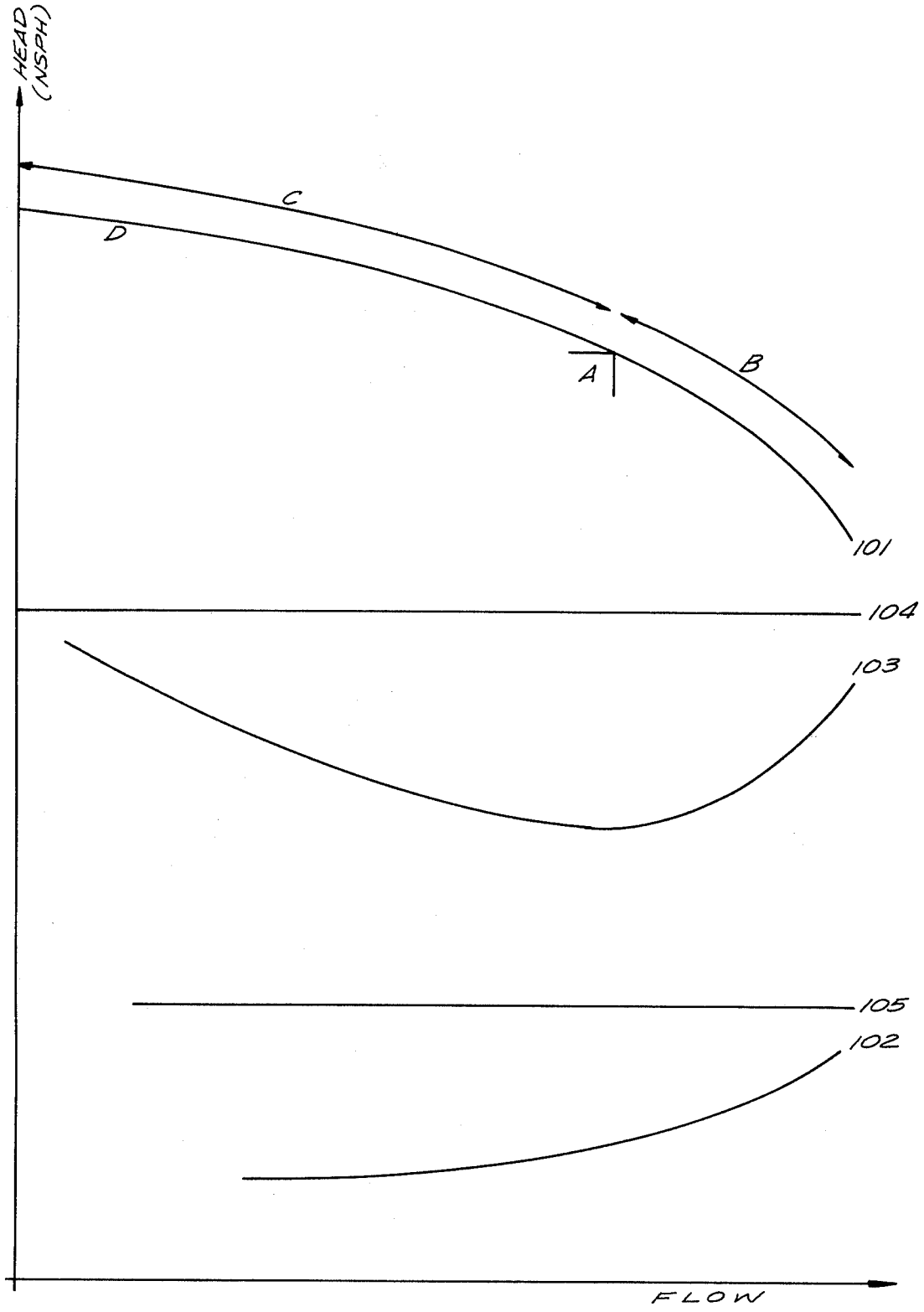
FIG. 3 is a diagram showing changes of net positive suction head during different stages of operation of a centrifugal pump with or without inlet vane means.

FIG. 3 is a diagram showing a performance curve 101 (also called head vs. flow curve). The point A of this curve is the point of maximum efficiency of a pump 3, D is the shutoff point, C is the low load or partial load range, and B is the runout or overload range.

The curve 102 represents the NPSH of a pump without inlet vane means.

The curve 103 represents the NPSH of a pump with inlet vane means.

The curve 104 represents NPSH which is available during normal operation.

The curve 105 represents NPSH which is available during loss of pressure.

In accordance with the invention, there are provided two different procedures for carrying out an automatic safety regulation, namely, influencing the NPSH over the entire range of flow and influencing the NPSH upstream of the pump. The two procedures can be employed separately or simultaneously.

Figure 4:
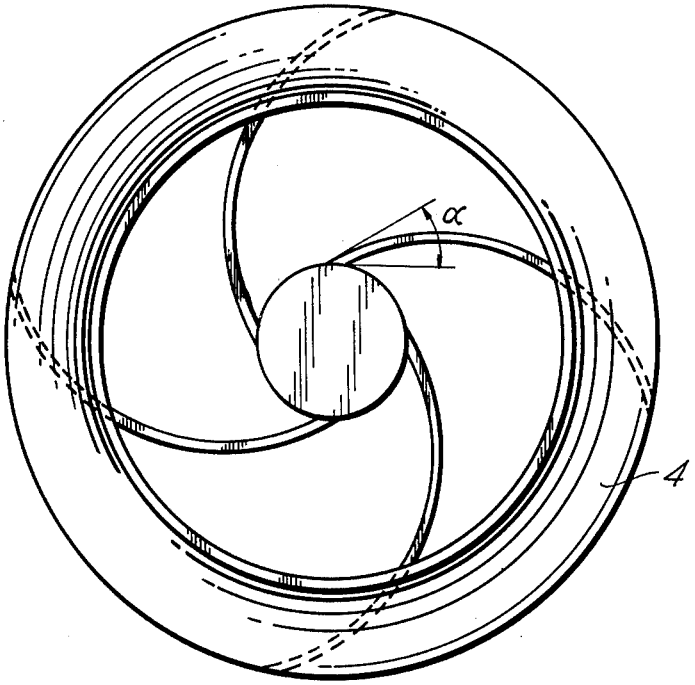
FIG. 4 is a bottom view of the pump impeller as seen from the suction side of the pump.
Figure 5:
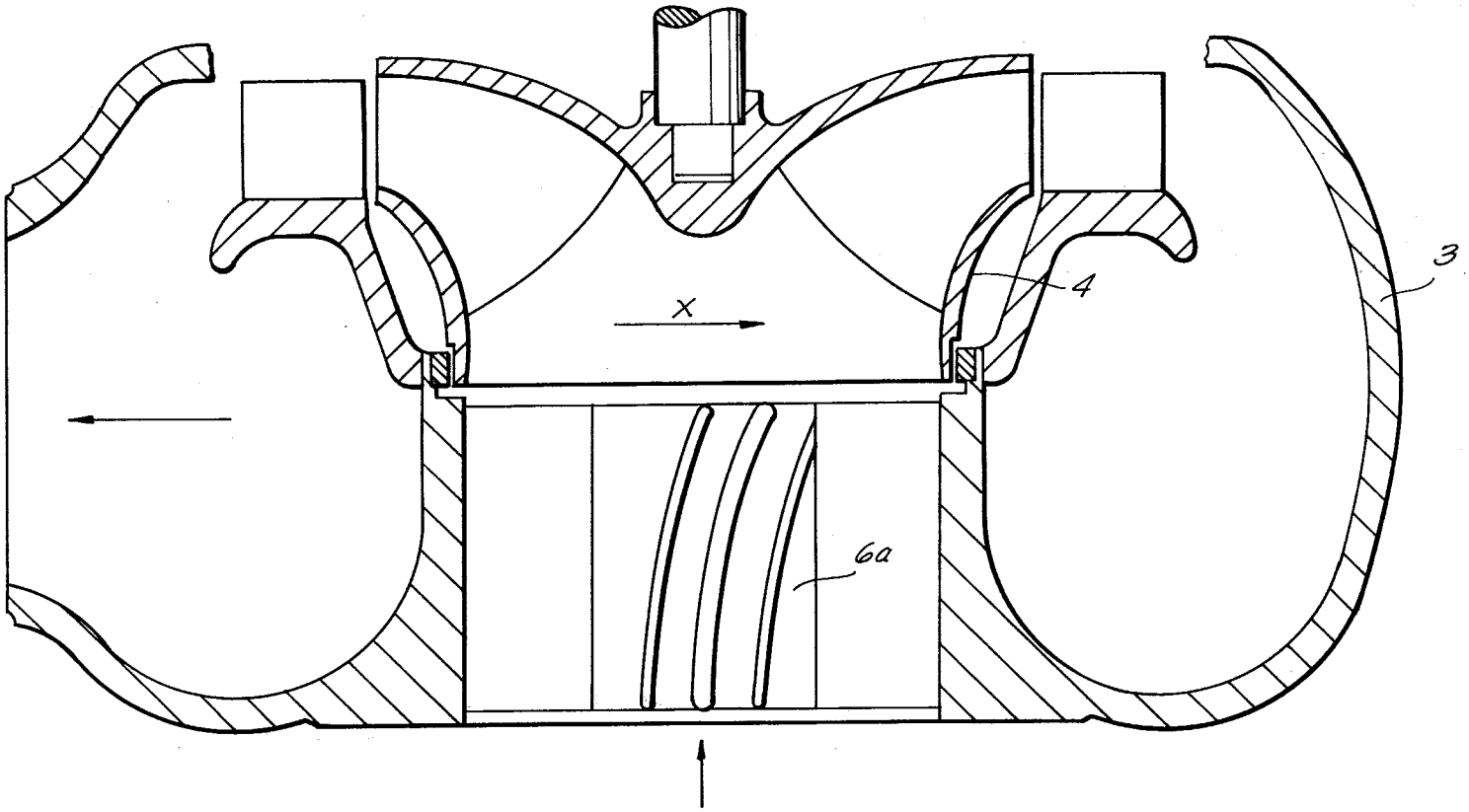
FIGS. 5 and 6 are sectional views similar to FIG. 2 and showing pumps provided with stationary guide wheels upstream of the pump impeller.
Figure 6:
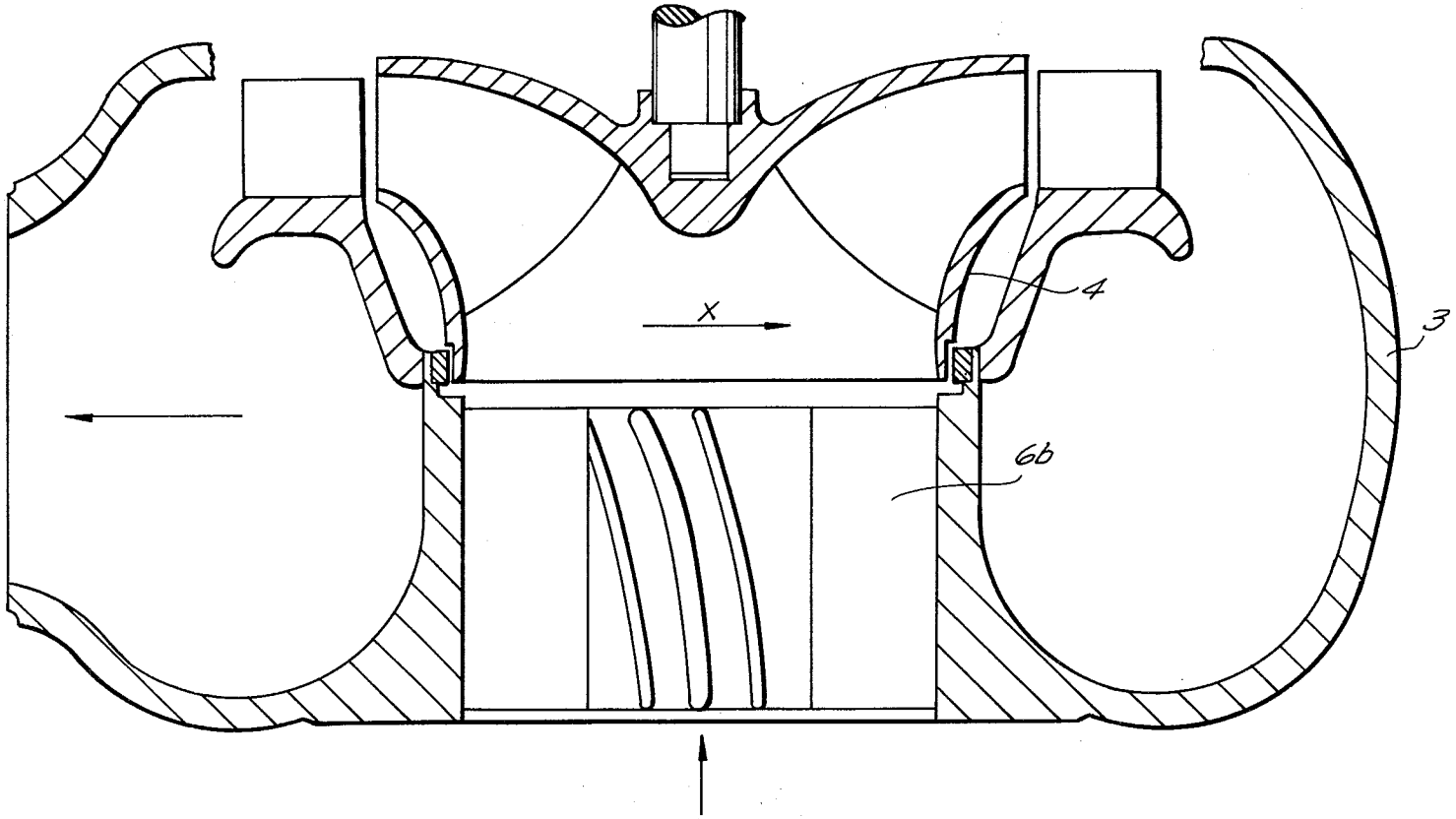

The influencing of NPSH over the entire flow range can be effected by an appropriate selection of the inlet angle $\alpha$ (FIG. 4) and inlet diameter D of the impeller 4 in FIG. 2. It is also possible to provide an auxiliary stationary guide wheel 6*a* (FIG. 5) upstream of the pump impeller which can produce in the inflowing stream an angular momentum, or initial rotational whirl in the fluid in the direction of rotation of the pump impeller or a stationary guide wheel 6*b* (FIG. 6) which can produce in the inflowing stream an angular momentum or an initial rotational whirl in the fluid counter the direction of rotation of the pump impeller. The auxiliary guide wheel can be omitted if guide vanes (5 in FIG. 2) are provided which are suitably bent at their free ends to produce in the inflowing stream an angular momentum in or counter the direction of rotation of the pump impeller. Such guide vanes are necessary parts of the centrifugal pump and a change in their configuration can be effected in such a way that the pump operates without cavitation at normal pressure but that the cavitation develops in immediate response to a drop of system pressure.

The second procedure (influencing the NPSH upstream of the pump) can include, for example, the interruption of admission of undercooled fluid upstream of the pump. Such undercooled fluid is supplied in many primary cooling systems for nuclear reactor plants.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In a closed circuit for the circulation of a fluid, particularly in the primary cooling circuit of a nuclear reactor plant, wherein the fluid is circulated by at least one centrifugal pump which operates without cavitation at normal system pressure, the improvement which conists in the provision of an arrangement for effecting the operation of said pump with full cavitation in response to a drop of said system pressure below said normal pressure to stop circulation of the fluid when a leak occurs in the primary cooling system, said arrangement including means for influencing the net positive suction head of said pump over the entire range of fluid flow, said means comprising a stationary guide wheel installed upstream of said pump.

2. The improvement as defined in claim 1, wherein said guide wheel is arranged to provide an initial rotation whirl to the fluid counter to the direction of rotation of the fluid by the impeller of the pump.

3. The improvement as defined in claim 1, wherein said guide wheel is arranged to provide an initial rotational whirl to the fluid in the direction of rotation of the fluid by the impeller of the pump.

* * * * *